United States Patent [19]

Ilin et al.

[11] 4,036,425

[45] July 19, 1977

[54] ROTOR FOR A CENTRIFUGE

[76] Inventors: Mikhail Ivanovich Ilin, ulitsa Sadovaya, 214, kv. 5, Krasnodar; Viktor Ivanovich Polyakov, Sudskoi proezd, 17, korpus 1, kv. 83, Moscow; Valery Alexandrovich Trofimov, ulitsa Kirova, 67, kv. 25, Penza; Ivan Karpovich Drankovsky, ulitsa Slavy, 5, kv. 41, Penza; Alexandr Ivanovich Boitsov, prospekt Pobedy, 91, kv. 60, Penza, all of U.S.S.R.

[21] Appl. No.: 667,946

[22] Filed: Mar. 18, 1976

Related U.S. Application Data

[63] Continuation of Ser. No. 575,424, May 7, 1975, abandoned, which is a continuation of Ser. No. 467,785, May 7, 1974, abandoned, which is a continuation of Ser. No. 332,137, Feb. 13, 1973, abandoned.

[51] Int. Cl.[2] ..... B04B 1/10; B04B 15/06

[52] U.S. Cl. ..... 233/2; 233/29; 233/47 R

[58] Field of Search ..... 233/1 R, 2, 16, 20 R, 233/27, 47 R, 28, 31, 37, 34, 35, 40, 41, 46, 45, 29

[56] References Cited

U.S. PATENT DOCUMENTS

| | | | |
|---|---|---|---|
| 2,254,127 | 8/1941 | Underwood | 233/45 X |
| 2,847,158 | 8/1958 | Thylefors | 233/21 |
| 2,893,629 | 7/1959 | Darnell | 233/2 X |
| 3,810,576 | 5/1974 | Polson | 233/37 |

*Primary Examiner*—George H. Krizmanich

[57] ABSTRACT

Disposed in the housing of a vane centrifuge concentrically therewith are two tapered accelerating bowls facing each other with their end faces of larger diameter so as to define a controlled gap therebetween serving to feed starting material therethrough to a filtering surface of the vanes.

4 Claims, 2 Drawing Figures

A-A

ROTOR FOR A CENTRIFUGE

This is a continuation of application Ser. No. 575,424 filed May 7, 1975 which in turn is a continuation of Ser. No. 467,785 filed May 7, 1974, which in turn is a continuation of Ser. No. 332,137 filed Feb. 13, 1973, all of which are now abandoned.

BACKGROUND OF THE INVENTION

The present invention relates to the separation of nonhomogeneous system of mixed components by the method of centrifugation, and more specifically to constructions used therefor, i.e., to centrifuges whose key component is a rotor. To be more precise, the present invention relates to the construction of rotors used in centrifuges an inertial discharge of the cake, predominantly in vane centrifuges.

The invention may find application in the food and chemical industries, pharmaceutics and other industrial fields which it is necessary to separate the liquid phase from the solid phase of fibrous, crystalline and grainy structure or from cellular vegetable tissue.

PRIOR ART

The key element of any centrifuge is a rotor. Known in the art is a perforated rotor with a tapered housing accommadation in its smaller base, a feeder in the form of a tapered acceleration bowl provided with perforations (Kopti model of inertia centrifuge made by Hein Leman G.m.B.H., the Federal Republic of Germany).

This feeding arrangement provides for a uniform distribution of the starting material over the entire area of the tapered rotor without a recourse to an additional distributing device.

Said such a feeding arrangement finds application in rotors of continuous centrifuges with an inertial discharge of the cake (USSR Inventor's Certificate No. 297,398).

A disadvantage of this feeding arrangement when used in conjunction with rotors of vane centrifuges is a considerable aeration of the starting material, i.e., its saturation with air because the feeding arrangement of such design is a kind of a fan. Due to the contact with air, materials of vegetable origin oxidize rapidly and those which must be separated at elevated temperature cool down rapidly, thereby impairing the process of separation since changes in the viscosity and coefficient of friction of the feed stock are inevitable.

Another disadvantage of the known feeder is that it is impossible to control a uniform feed of the starting material to the filtering surface without an additional arrangement and also an ineffective utilization of the filtering area of the vanes due to the formation of dead zones, particularly below the upper edge of the feeder.

SUMMARY OF THE INVENTION

An object of the present invention is to provide a centrifuge rotor which will enable a more complete utilization of the filtering surface of the vanes.

Another object of the present invention is to provide a centrifuge rotor so designed as to ensure a higher quality of finished the product.

Said objects are accomplished in a centrifuge rotor comprising a housing provided with a removable sealing lid arranged concentrically, a tapered accelerating bowl disposed in said housing and attached concentrically to its bottom, filtering vanes disposed in said housing and pivotally attached around the circumference of said bowl, each with its end spaced at a minimum distance from the axis of housing between said bottom and said lid and, according to the invention, an additional tapered accelerating bowl is attached to said lid concentrically with the housing so that both bowls face each other with their end faces of larger diameter and define a gap for feeding the starting material therethrough to the filtering surface, with both diameters being equal.

The provision of an additional accelerating means cooperating with the existing means provides a feeder in the form of a slotted hydraulic lock which causes a layer of starting material to bridge the gap between the bowls during the process of centrifugation. This makes for the most complete utilization of filtering surface of the vanes and prevents the aeration of the starting material during separation, since no air is admitted to the filtering vanes. In processing products of vegetable origin (preparation of fruit juices and pastes), this avoids oxidation and retains the original quality of the products. In separating suspensions at elevated temperatures, said arrangement prevents cooling down of the suspension because of a negligible contact with air, retains the original viscosity and coefficient of friction and adds to the quality of the separation.

According to an embodiment of the invention, the additional accelerating bowl in the centrifuge rotor may be installed with a provision for an axial displacement. This displacement controls the clearance between the end faces of the bowls for feeding the starting material to the filtering surface of the vanes and provides, in turn, a means for controlling the amount of starting material fed to the vanes or, in other words, the overall capacity of the centrifuge.

To obtain a conical gap between the accelerating bowls, it is desirable to provide the largest diameters of the bowls with internally bevelled edges. The presence of conical slit facilitates the shaping of the starting material in an annular jet so as to provide for a more complete filling of the filtering surface of the vanes and increase the capacity of the rotor.

It is also desirable to provide the end face of the smallest diameter of the additional accelerating bowl with outward and inward flangings, of which the outward flanging serves as support mounting the additional accelerating bowl on the sealing lid, while the inward flanging allows a layer of staring material to be obtained inside the accelerating bowls which in thick enough to ensure the bridging of the gap between the bowls by the starting material throughout the entire period of centrifugation.

Other objects and advantages of the present invention will be best understood from the following detailed description of a preferred embodiment when read in conjunction with the accompanying drawings in which:

DESCRIPTION OF THE PREFERRED EMBODIMENTS

Figure 1:
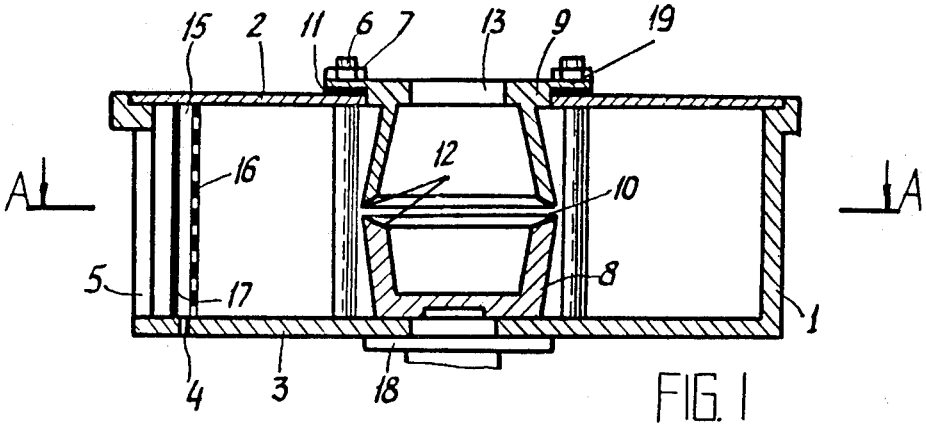
FIG. 1 is a longitudinal section of the centrifuge rotor according to the invention.
Figure 2:
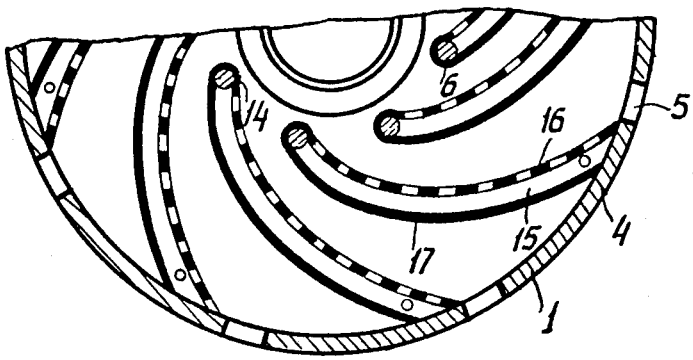
FIG. 2 illustrates a cross section of the same centrifuge rotor along line A—A.

The centrifuge rotor comprises a cylindrical housing 1 with a removable sealing lid 2 arranged on the horizontal top surface of the housing concentrically therewith. A bottom 3 of the housing 1 is provided with ports 4 serving to discharge the liquid phase of the treated product from the rotor. The cylindrical housing 1 has vertical slits 5 to discharge the solid phase of the centrifuged product. The lid 2 is secured to the housing 1 with the aid of pins 6, fixed at one end in the bottom 3, and nuts 7.

Disposed in the housing 1 concentrically therewith are two tapered accelerating bowls 8 and 9. The bowl 8 attached to the bottom 3 of the housing 1 and the bowl 9 secured to the lid 2 are arranged so that their end faces of larger diameter face one another, defining a gap 10. The bowl 9 is fixed to the lid 2 by a pin 6 and a nut 7.

It has been found that the end faces of larger diameter of the accelerating bowls 8 and 9 must be equal to each other in order to ensure a uniform distribution of the starting material over the filtering surface, control the feed and prevent the aeration of the material used.

The accelerating bowl 9 is provided with an outer flange 19 which overlaps the lid 2. In addition, an adjusting washer 11 is disposed between the outward flangings 19 of the accelerating bowl 9 and the lid 2. Washers 11 of different thickness allow the width of the gap 10 to be changed so as to adjust the quantity of starting product fed to the filtering vanes.

A point to be stressed is that both accelerating bowls 8 and 9 have inwardly bevelled edges at their end faces of larger diameter because such feature of the internal shape of the bowls 8 and 9 improves the shaping of the starting material in an annular jet which is a factor providing, in turn, for a more complete filling of the filtering surface of the vanes by the material and for an increased capacity of the rotor.

Furthermore it has been found desirable to provide the bowl 9 with an inward flanging 13 at its end face of smaller diameter for the purpose of obtaining a layer of starting material thick enough to ensure the bridging of the gap 10 between the bowls 8 and 9 throughout the entire period of centrifugation, thus preventing the aeration of starting material. In addition, the bore of the inward flanging 13 serves as the charging port.

Disposed in the housing 1 are also filtering vanes 14, each of which consists of two elements with a space 15 therebetween, with one of elements being perforated and serving as a sieve 16, while the other element is the housing 17 of the vane 14, wherein the sieve 16 is disposed. The space 15 serves to collect the liquid phase of the product passing through the sieve 16.

The filtering vanes 14 are arranged in the housing 1 of the rotor uniformly around the circumference of the accelerating bowls 8 and 9, between the bottom 3 and the lid 2. The housing 17 of the vane 14 spaced at a minimum distance from the axis of the housing 1 is fixed in position with the help of a pivot whose axle is the pin 6. The pivot point of each vane 14 is located outside and adjacent to the gap 10 between the bowls 8 and 9. The housing 17 of the vane 14 spaced at a maximum distance from the axis of the housing 1 rests on the internal diameter surface of the rotor cylindrical housing 1. It must be emphasized that the number of vertical slits 5 and ports 4 is equal to that of the vanes 14 installed in the housing 1.

The operation of the rotor according to the invention during the process of centrifugating a starting material is as follows.

The starting material fed into the bottom of the accelerating tapered bowl 8 is acted upon by a centrifugal force which causes it to rise up the inner surface of the bowl and, mainly passing through the gap 10, reaches the vanes 14, simultaneously passing over the inner surface of the additional accelerating bowl 9. A layer of spinning starting material so formed completely bridges the gap 10, thus preventing the ingress of air therethrough.

The starting material, on reaching a vane 14 moves along the sieve 16 thereof due to the action of the tangential component of centrifugal force and in the course of this movement, the solid phase of starting material is separated from the liquid phase. On reaching the end of the vane 14, the solid phase is discharged from the rotor through the slits 5.

The liquid phase of the starting material in passing through the perforations of the sieve 16 accumulates in the space 15 defined by the sieve 16 and the housing 17 of the vane 14, and is discharged therefrom through the ports 4 in the bottom 3 of the rotor housing 1. The process of separating the solid phase of starting material from the liquid phase takes place without ingress of air into the rotor.

The output of the centrifuge is controlled by changing the width of the gap 10 with the aid of the additional accelerating bowl 9 which, secured to the lid 2 of the rotor, can be moved toward and away from the bowl 8.

As indicated above, the, shims 11 are used to adjust the width of the gap 10.

What is claimed is:

1. A centrifuge rotor comprising: a housing with a removable sealing lid arranged concentrically; a tapered accelerating bowl disposed inside said housing and attached to the bottom thereof concentrically; filtering vanes arranged inside said housing between the bottom thereof and said lid, each filtering vane being pivotally attached at its end which is spaced at a minimum distance from the axis of the housing, said rotor housing accommodating an additional tapered accelerating bowl secured concentrically to said housing on said lid so that the two bowls face each other with their end faces of the largest diameters and define a gap therebetween through which the starting product is fed to the filtering surface of the vanes, said diameters being equal.

2. The rotor of claim 1, wherein the additional accelerating bowl is provided with an outer flange which overlaps the lid of the rotor housing to define a space between said flange and said lid or receiving replaceable shims of different thickness to alter the width of the gap between said additional bowl and the accelerating bowl arranged on the bottom with the assistance of said replaceable shims of different thickness which are placed between the additional accelerating bowl and the lid of the rotor housing.

3. The rotor of claim 1, wherein the end faces having the largest diameter of both accelerating bowls are provided with internally bevelled edges.

4. The rotor of claim 1, wherein the additional accelerating bowl mounted on the housing lid has its smallest diameter provided with outward and inward flangings.

* * * * *